US009802088B1

(12) United States Patent
Chou et al.

(10) Patent No.: US 9,802,088 B1
(45) Date of Patent: Oct. 31, 2017

(54) GOLF CLUB HEAD

(71) Applicant: Advanced International Multitech Co., Ltd., Kaohsiung (TW)

(72) Inventors: I-Nan Chou, Kaohsiung (TW); Te-Fu Hsiao, Kaohsiung (TW); Yu-Jui Pan, Kaohsiung (TW)

(73) Assignee: ADVANCED INTERNATIONAL MULTITECH CO., LTD., Kaohsiung (TW)

( * ) Notice: Subject to any disclaimer, the term of this patent is extended or adjusted under 35 U.S.C. 154(b) by 0 days.

(21) Appl. No.: 15/599,082

(22) Filed: May 18, 2017

(30) Foreign Application Priority Data

Dec. 30, 2016 (TW) ..... 105144064 A

(51) Int. Cl.
*A63B 69/36* (2006.01)
*A63B 53/04* (2015.01)

(52) U.S. Cl.
CPC ..... *A63B 53/0466* (2013.01); *A63B 69/3632* (2013.01); *A63B 53/04* (2013.01); *A63B 53/047* (2013.01); *A63B 2053/0433* (2013.01); *A63B 2053/0491* (2013.01); *A63B 2220/833* (2013.01)

(58) Field of Classification Search
CPC . A63B 53/0466; A63B 69/3632; A63B 53/04; A63B 2053/0433; A63B 2053/0491; A63B 53/047; A63B 2220/833
USPC ..... 473/199, 131, 455, 570, 219, 242, 231, 473/324, 220–226; 273/460; 463/36–39, 463/46, 47
See application file for complete search history.

(56) References Cited

U.S. PATENT DOCUMENTS 3,270,564 A * 9/1966 Evans ..... A63B 69/3632 340/539.1
6,913,542 B1 * 7/2005 Hu ..... A63B 69/3614 473/220
6,935,965 B1 * 8/2005 DeVarney ..... A63B 69/3635 473/224
7,780,535 B2 * 8/2010 Hagood ..... A63B 53/04 463/47
8,117,903 B2 * 2/2012 Golden ..... A63B 24/0003 473/223
8,210,960 B1 * 7/2012 Davenport ..... A63B 24/0006 273/108.2
8,668,595 B2 * 3/2014 Boyd ..... A63B 24/0003 473/223

(Continued)

FOREIGN PATENT DOCUMENTS

WO WO 2012/149338 A1 11/2012

*Primary Examiner* — Sebastiano Passanti
(74) *Attorney, Agent, or Firm* — Muncy, Geissler, Olds & Lowe, P.C.

(57) ABSTRACT

A golf ball head includes a head unit and an insertion unit. The insertion unit includes a housing body, an intelligent unit and an encapsulant. The housing body is threaded into an installation hole of the head unit, defines a receiving space, and has a base wall, a surrounding wall, an external thread for threadedly engaging the internal thread, and a recess formed in the base wall. The intelligent unit is received in the receiving space, and includes a circuit board, two charging electrodes disposed on the first circuit board, and a capacitor connected to the first circuit board and the charging electrodes. The encapsulant is received in the receiving space and exposes the charging electrodes.

5 Claims, 4 Drawing Sheets

(56) References Cited

U.S. PATENT DOCUMENTS

| | | | | |
|---|---|---|---|---|
| 8,784,228 | B2 * | 7/2014 | Morin | A63B 69/36 473/219 |
| 8,951,145 | B2 * | 2/2015 | Bezilla | A63B 53/04 473/334 |
| 9,333,390 | B1 * | 5/2016 | Manwaring | A63B 24/0003 |
| 9,492,707 | B2 * | 11/2016 | Chou | A63B 53/0466 |
| 9,724,578 | B2 * | 8/2017 | Zhao | A63B 51/00 |
| 2005/0032582 | A1 * | 2/2005 | Mahajan | A63B 69/00 473/222 |
| 2006/0166738 | A1 * | 7/2006 | Eyestone | A63B 15/005 463/36 |
| 2006/0178229 | A1 * | 8/2006 | Liang | A63B 53/0466 473/334 |
| 2009/0105004 | A1 * | 4/2009 | Cheresko | A63B 69/3614 473/234 |
| 2011/0312453 | A1 * | 12/2011 | Chu | F42B 12/42 473/570 |
| 2012/0052973 | A1 * | 3/2012 | Bentley | A63B 69/36 473/223 |
| 2015/0231478 | A1 * | 8/2015 | Boggs | A63B 69/3632 473/223 |
| 2016/0074720 | A1 * | 3/2016 | Kline | A63B 53/06 473/223 |

* cited by examiner

GOLF CLUB HEAD

CROSS-REFERENCE TO RELATED APPLICATION

This application claims priority of Taiwanese Patent Application No. 105144064, filed on Dec. 30, 2016.

FIELD

The disclosure relates to a golf club head.

BACKGROUND

With the development of modern society, golfing is increasingly gaining its popularity. Numerous data, such as the force exerted onto a golf ball by a player hitting the golf ball with a golf club, or the speed and trajectory the golf ball travels, need to be collected and analyzed for improving performance of the player. In addition, the weight of a golf club head of the golf club may need to be changed for performance optimization.

Referring to FIG. 1, International Publication Number WO 2012/149338 A1 discloses a golf club head that includes a main body 101 formed with a recess 102, a monitoring device 103, a cover plate 104 formed with an opening 105, and a screw 106. The monitoring device 103 is received in the recess 102 and corresponds in position to the opening 105. The screw 106 fixes the cover plate 104 to the main body 101. The monitoring device 103 collects the abovementioned data and transfers such data wirelessly. The opening 105 ensures transmission-out of the wireless data is not blocked. However, use of different monitoring devices 103 having distinct sizes requires the main body 101 to be changed for accommodating a corresponding monitoring device 103.

SUMMARY

Therefore, an object of the present disclosure is to provide a golf club head that can alleviate the drawback associated with the prior art.

According to the present disclosure, a golf ball head includes a head unit and an insertion unit.

The head unit includes a main body, an installation hole formed in the main body, and an internal thread formed on an inner wall surface of the main body and defining the installation hole.

The insertion unit includes a housing body, an intelligent unit and an encapsulant. The housing body defines a receiving space having an opening, and has a base wall, a surrounding wall, an external thread and a recess. The surrounding wall extends from a periphery of the base wall. The external thread is formed on an outer surface of the surrounding wall for threadedly engaging the internal thread of the head unit so that the insertion unit is detachably received in the installation hole. The recess is formed in the base wall and is adapted to permit a tool to be engaged and rotated therein so as to rotate the housing body relative to the head unit. The intelligent unit is received in the receiving space, and includes a first circuit board disposed in the opening of the receiving space, two charging electrodes disposed on the first circuit board, and a capacitor electrically connected to the first circuit board and the charging electrodes. The encapsulant is received in the receiving space, at least partially covers the first circuit board of the intelligent unit, and fixes the intelligent unit in the receiving space. The charging electrodes are exposed from the encapsulant.

BRIEF DESCRIPTION OF THE DRAWINGS

Other features and advantages of the present disclosure will become apparent in the following detailed description of the embodiment with reference to the accompanying drawings, of which.

DETAILED DESCRIPTION

Figure 1:
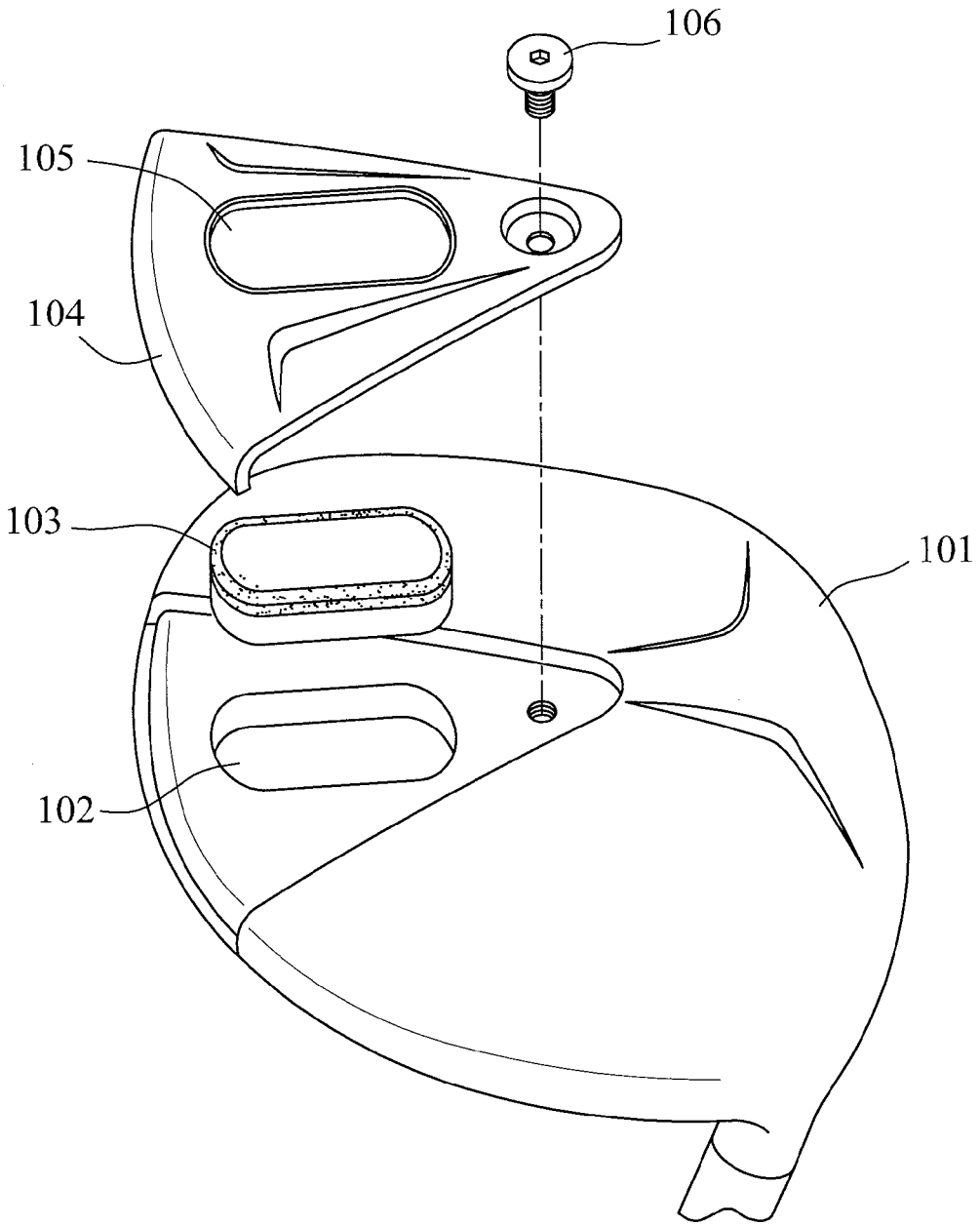
FIG.1 PRIOR ART
FIG. 1 is a fragmentary exploded perspective view showing a golf club head of International Publication Number WO 2012/149338 A1.
Figure 2:
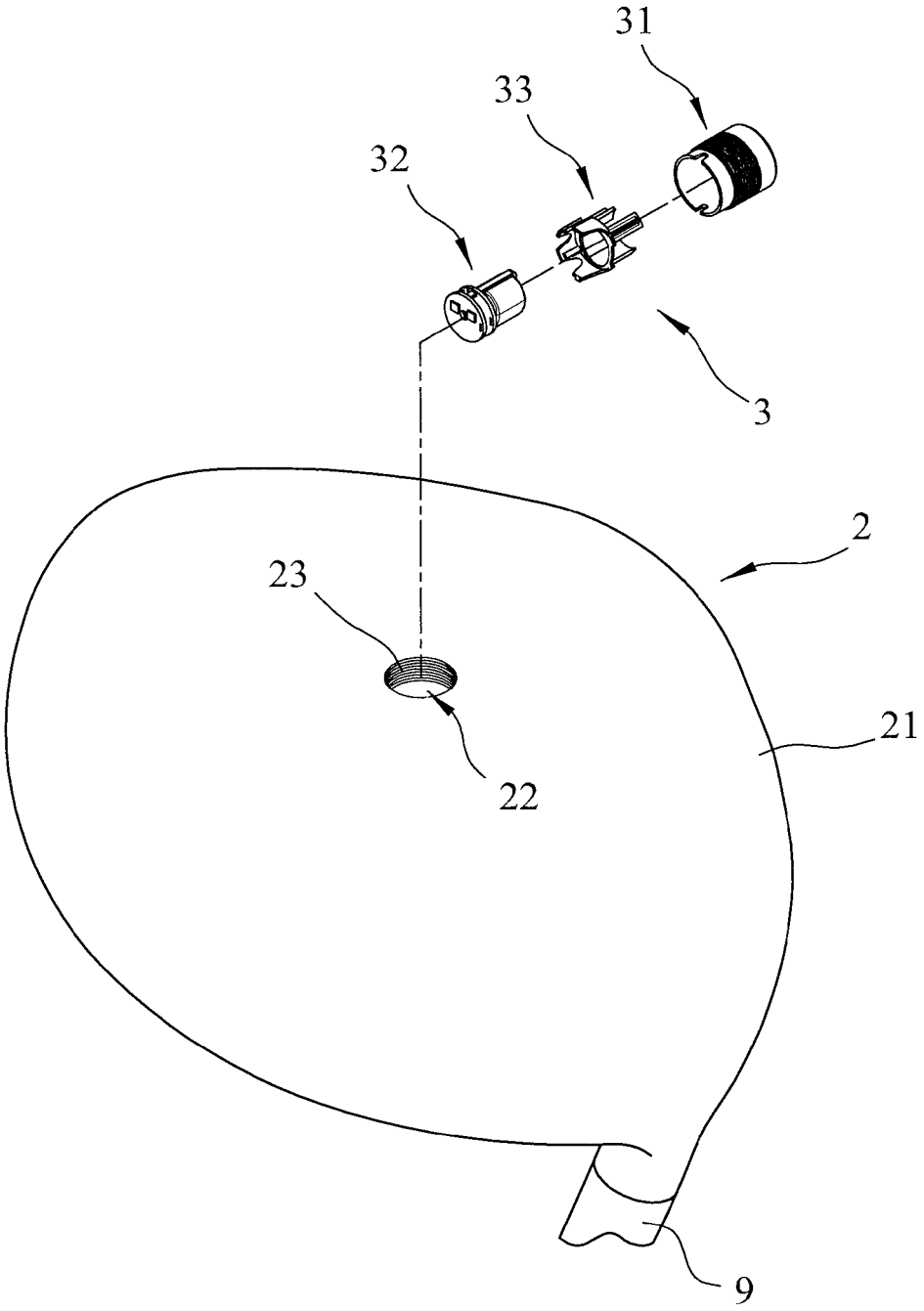
FIG. 2 is a fragmentary exploded perspective view of an embodiment of a golf club head according to the present disclosure.

Referring to FIG. 2, an embodiment of a gold club head of the present disclosure includes a head unit 2 and an insertion unit 3. The head unit 2 of the gold club head is connected to a shaft 9 that is to be handled by a player.

Figure 3:
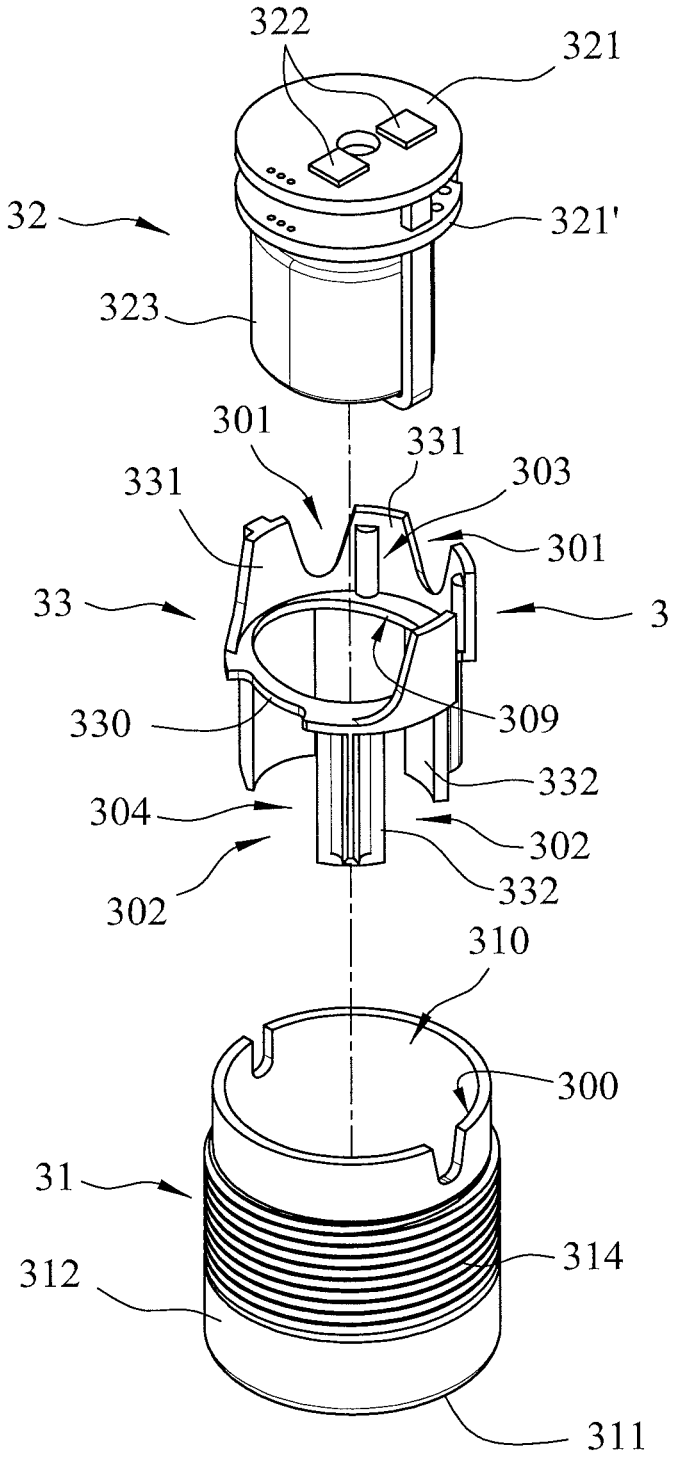
FIG. 3 is an exploded perspective view showing an insertion unit of the embodiment.
Figure 4:
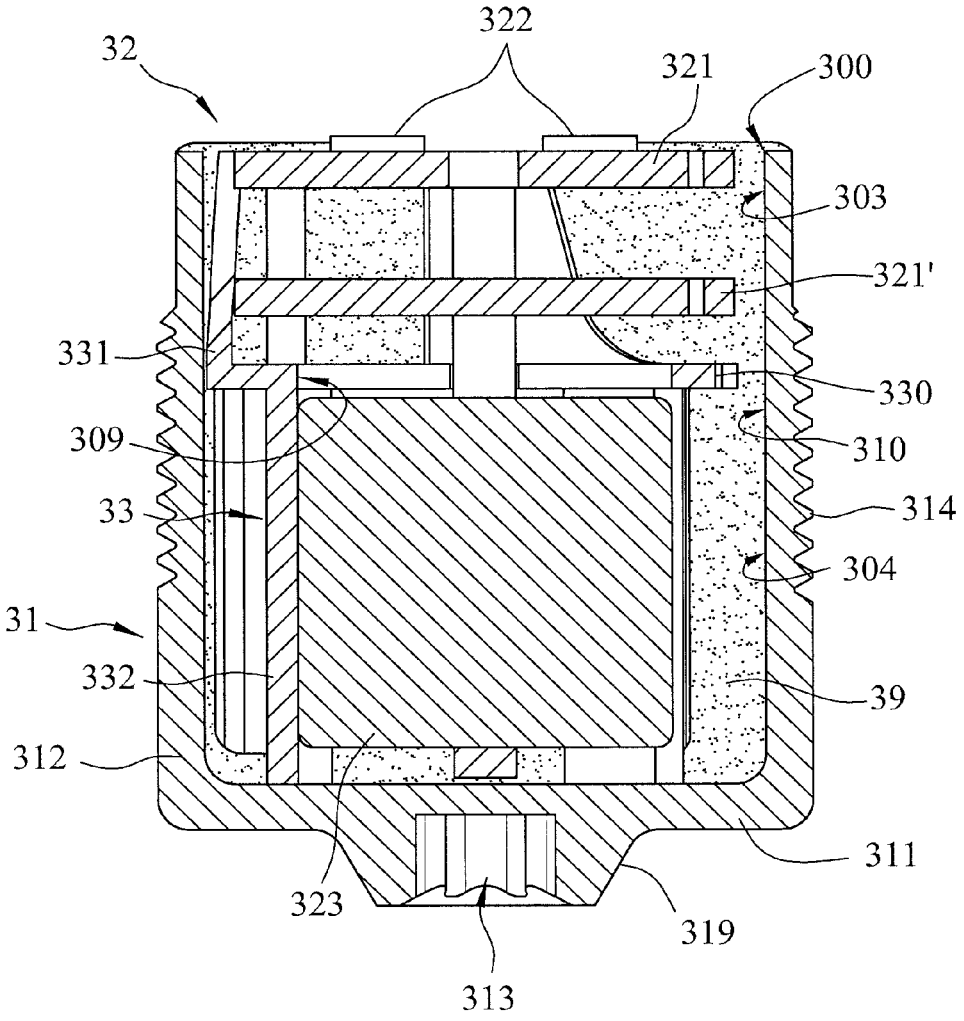
FIG. 4 is a sectional view of the insertion unit of the embodiment.

Referring further to FIGS. 3 and 4, the head unit 2 includes a main body 21, an installation hole 22 formed in the main body 21, and an internal thread 23 formed on an inner wall surface of the main body 21 and defining the installation hole 22. As shown in FIG. 2, the installation hole 22 is formed in a bottom surface of the gold club head facing away from the shaft 9. However, the location of the installation hole 22 may be changed according to practical requirements.

The insertion unit 3 includes a housing body 31, an intelligent unit 32, a holding unit 33 and an encapsulant 39. The housing body 31 defines a receiving space 310 having an opening 300, and has a base wall 311, a surrounding wall 312 extending from a periphery of the base wall 311, an external thread 314 formed in an outer surface of the surrounding wall 312 for threadedly engaging the internal thread 23 of the head unit 2 so that the insertion unit 3 is detachably received in the installation hole 22, and a recess 313 (see FIG. 4) formed in the base wall 311 and adapted to permit a tool (not shown), such as a screw driver, to be engaged and rotated therein so as to rotate the housing body 31 relative to the head unit 2 for mounting the insertion unit 3 to the head unit 2 or dismounting the insertion unit 3 from the head unit 2. In this embodiment, the base wall 311 of the housing body 31 has a protrusion portion 319 (see FIG. 4) that extends away from the receiving space 310, and the recess 313 is formed in the protrusion portion 319.

The holding unit 33 is received in the receiving space 310, and has a base plate 330 that is formed with a through hole 309 through which the intelligent unit 32 extends, a plurality of first extending portions 331 that extends from the base plate 330 in a direction away from the base wall 311, and a plurality of second extending portions 332 that extend from the base plate 330 in a direction toward the base wall 311. Any two adjacent ones of the first extending portions 331 cooperatively define a first encapsulant-receiving space 301 therebetween. Any two adjacent ones of the second extending portions 332 cooperatively define a second encapsulant-receiving space 302 therebetween. The first extending portions 331 and the base plate 330 cooperatively define a board-receiving space 303. The second extending portions 332 and the base plate 330 cooperatively define a capacitor-receiving space 304. In this embodiment, the holding unit 33 is press fitted within the surrounding wall 312 of the housing body 31 such that the holding unit 33 is fixedly received in the housing body 31.

The intelligent unit 32 is received in the receiving space 310, extends through the holding unit 33, and includes a first circuit board 321, a second circuit board 321', two charging electrodes 322 and a capacitor 323. The first circuit board 321 is disposed in the opening 300 of the receiving space 310, and is received in the board-receiving space 303. The second circuit board 321' is spaced apart from the first circuit board 321 and is received in the board-receiving space 303. The charging electrodes 322 are disposed on a side surface of the first circuit board 321 facing away from the second circuit board 321'. In certain embodiments, other measuring elements (not shown) may be provided on the first circuit board 321 for measuring various data of the golf club head and a golf ball (not shown) hit by the golf club head. The capacitor 323 is received in the capacitor-receiving space 304, and is electrically connected to the first circuit board 321 and the second circuit board 321'. When the insertion unit 3 is disassembled from the head unit 2, the charging electrodes 322 may be electrically connected to an external power source (not shown) for providing electrical power to the capacitor 323 such that the electrical power is received in the capacitor 323.

The encapsulant 39 is received in the receiving space 310, at least partially covers the first circuit board 321 of the intelligent unit 32, and fixes the intelligent unit 32 in the receiving space 310. The charging electrodes 322 are exposed from the encapsulant 39. In this embodiment, a portion of the encapsulant 39 is filled in the first encapsulant-receiving spaces 301 defined by the first extending portions 331. Another portion of the encapsulant 39 is filled in the second encapsulant-receiving spaces 302 defined by the second extending portions 332.

The holding unit 33 ensures that there is a gap between the housing body 31 and the intelligent unit 32, and the encapsulant 39 can therefore fill up the gap for encapsulating and fixing the intelligent unit 32.

The insertion unit 3 provides a counterweight to the head unit 2. The weight of the insertion unit 3 may be adjusted by changing the material of the holding unit 33, changing the density of the encapsulant 39, or placing additional counterweight members (not shown) in the receiving space 310.

In order to test the durability of the golf club head of this disclosure, the golf club head was tested by hitting the golf ball at a speed of 46 meters per second. The results show that the golf club head of this disclosure is capable of withstanding more than 3000 hits with the intelligent unit 32 still functioning.

In summary, the insertion unit 3 of this disclosure can be easily mounted to or dismounted from the head unit 2, and can be changed according to practical requirements. The intelligent unit 32 may be changed for measuring various data of the golf club head of this disclosure and the golf ball hit by the golf club head. The holding unit 33 and the encapsulant 39 may be changed for adjusting weight of the insertion unit 3 according to practical requirements.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A golf club head comprising:

a head unit including a main body, an installation hole formed in said main body, and an internal thread formed on an inner wall surface of said main body and defining said installation hole; and an insertion unit including a housing body that defines a receiving space having an opening, and that has a base wall, a surrounding wall extending from a periphery of said base wall, an external thread formed on an outer surface of said surrounding wall for threadedly engaging said internal thread of said head unit so that said insertion unit is detachably received in said installation hole, and a recess formed in said base wall and adapted to permit a tool to be engaged and rotated therein so as to rotate said housing body relative to said head unit, an intelligent unit that is received in said receiving space, and that includes a first circuit board disposed in said opening of said receiving space, two charging electrodes disposed on said first circuit board, and a capacitor electrically connected to said first circuit board and said charging electrodes, and an encapsulant that is received in said receiving space, that at least partially covers said first circuit board of said intelligent unit, and that fixes said intelligent unit in said receiving space, said charging electrodes being exposed from said encapsulant.

2. The golf club head as claimed in claim 1, wherein said insertion unit further includes a holding unit that is received in said receiving space, said intelligent unit extending through and being fixed to said holding unit.

3. The golf club head as claimed in claim 2, wherein said holding unit has a base plate formed with a through hole through which said intelligent unit extends, a plurality of first extending portions extending from said base plate in a direction away from said base wall, and a plurality of second extending portions extending from said base plate in a direction toward said base wall, any two adjacent ones of said first extending portions cooperatively defining a first encapsulant-receiving space therebetween, in which a portion of said encapsulant is filled, any two adjacent ones of said second extending portions cooperatively defining a second encapsulant-receiving space therebetween, in which another portion of said encapsulant is filled, said first extending portions and said base plate cooperatively defining a board-receiving space that receives said first circuit board of said intelligent unit, said second extending portions and said base plate cooperatively defining a capacitor-receiving space (304) that receives said capacitor of said intelligent unit.

4. The golf club head as claimed in claim 1, wherein said base wall of said housing body has a protrusion portion that extends away from said receiving space, said recess being formed in said protrusion portion.

5. The golf club head as claimed in claim 1, wherein said intelligent unit of said insertion unit further includes a second circuit board that is spaced apart from said first circuit board, said capacitor being further electrically connected to said second circuit board.

* * * * *